US005721055A

United States Patent [19]

Feldstein

[11] Patent Number: 5,721,055

[45] Date of Patent: Feb. 24, 1998

[54] LUBRICATED TEXTILE SPINNING MACHINERY PARTS

[75] Inventor: Nathan Feldstein, Princeton, N.J.

[73] Assignee: Surface Technology, Inc., Trenton, N.J.

[21] Appl. No.: 566,323

[22] Filed: Dec. 1, 1995

Related U.S. Application Data

[63] Continuation of Ser. No. 367,626, Jan. 3, 1995, abandoned.

[51] Int. Cl.[6] ..... B32B 17/00

[52] U.S. Cl. ..... 428/457; 428/325; 57/119; 57/416; 57/417

[58] Field of Search ..... 57/119, 400, 404, 57/416, 417; 428/457, 325

[56] References Cited

U.S. PATENT DOCUMENTS

| | | | |
|---|---|---|---|
| Re. 33,767 | 12/1991 | Christini | 428/544 |
| 3,614,183 | 10/1971 | Berens | 384/486 |
| 3,617,363 | 11/1971 | Metzger | 384/486 |
| 3,677,907 | 7/1972 | Brown | 205/109 |
| 3,723,078 | 3/1973 | Parker | 428/559 |
| 3,753,667 | 8/1973 | Metzger | 428/639 |
| 3,787,294 | 1/1974 | Kurosaki | 205/109 |
| 4,098,654 | 7/1978 | Helle | 205/50 |
| 4,193,253 | 3/1980 | Herbert | 57/414 |
| 4,302,374 | 11/1981 | Helle | 524/168 |
| 4,358,922 | 11/1982 | Feldstein | 57/401 |
| 4,358,923 | 11/1982 | Feldstein | 57/401 |
| 4,547,407 | 10/1985 | Spencer | 427/367 |
| 4,622,170 | 11/1986 | Raasch | 57/416 |
| 4,663,929 | 5/1987 | Raasch | 57/416 |
| 4,666,786 | 5/1987 | Yano | 428/544 |
| 4,677,817 | 7/1987 | Kanai | 57/125 |
| 4,698,958 | 10/1987 | Nakano | 57/119 |
| 4,830,889 | 5/1989 | Henry | 427/438 |
| 4,866,927 | 9/1989 | Fetzer | 57/416 |
| 4,885,905 | 12/1989 | Maruta | 57/119 |
| 4,928,477 | 5/1990 | Kalitzki | 57/416 |
| 4,997,686 | 3/1991 | Feldstein | 427/443.1 |
| 5,086,615 | 2/1992 | Bodnar | 57/120 |
| 5,145,517 | 9/1992 | Feldstein | 106/605 |
| 5,164,236 | 11/1992 | Schmid | 428/344 |
| 5,265,406 | 11/1993 | Hofmann | 57/417 |
| 5,300,330 | 4/1994 | Feldstein | 427/443.1 |
| 5,313,773 | 5/1994 | Poquette | 57/119 |
| 5,389,229 | 2/1995 | Feldstein | 427/304 |

*Primary Examiner*—Timothy Speer

*Attorney, Agent, or Firm*—Lerner, David, Littenberg, Krumholz & Mentlik

[57] ABSTRACT

Disclosed is a method for the coating of textile spinning machinery parts with a composite coating bearing finely divided lubricating particles dispersed within a hard metallic matrix. The lubricating particles are particulate matter capable of withstanding heat-treatment temperatures of at least 300° C. without their degradation.

24 Claims, No Drawings

LUBRICATED TEXTILE SPINNING MACHINERY PARTS

This is a continuation of application Ser. No. 08/367,626 filed Jan. 3, 1995, now abandoned.

BACKGROUND OF THE INVENTION

The plating of articles with a composite coating bearing finely dispersed divided particulate matter is well documented. This technology has been widely practiced in the field of electroplating as well as electroless plating. The acceptance of such composite coating stems from the recognition that the inclusion of finely divided particulate matter within metallic matrices can significantly alter the properties of the coating with respect to properties such as wear resistance, lubricity, and appearance.

Electroless composite technology is a more recent development as compared to electrolytic composite technology. The state of the art in composite electroless plating is documented in a recent text entitled "Electroless Plating Fundamentals and Applications," edited by G. Mallory and J. B. Hajdu, Chapter 11, published by American Electroplaters and Surface Finishers Society (1990).

The evolution of composite electroless plating dates back to Oderkerken U.S. Pat. No. 3,614,183 in which a structure of composite electroless plating with finely divided aluminum oxide was interposed between electrodeposited layers to improve the corrosion resistance. Thereafter, Metzger et al, U.S. Pat. Nos. 3,617,363 and 3,753,667 extended the Oderkerken work to a great variety of particles and miscellaneous electroless plating baths. Thereafter, Christini et al in Reissue Patent 33,767 further extended the composite electroless plating to the codeposition of diamond particles. In addition, Christini et al demonstrated certain advantages associated with the deposition of the barrier layer (strike) prior to the composite layer.

Feldstein in U.S. Pat. Nos. 4,358,922 and 4,358,923 demonstrated the advantages of utilizing a metallic layer above the composite layer. The overlayer is essentially free of any particulate matter. Spencer in U.S. Pat. No. 4,547,407 demonstrated the utilizing of a mixture of dual sized particles in achieving improved smoothness of coating. Feldstein et al in U.S. Pat. Nos. 4,997,686, 5,145,517, and 5,300,330 demonstrated utilization of particulate matter stabilizers in the deposition of uniform stable composite electroless plating. Parker in U.S. Pat. No. 3,723,078 demonstrated the codeposition of refractory metals and chromium along with composite electroless plating.

Helle et al in U.S. Pat. Nos. 4,098,654 and 4,302,374 have explored special surfactant compositions in the preparation of stabilized PTFE dispersions and their subsequent utilization in electrolytic plating.

Kurosaki et al in U.S. Pat. No. 3,787,294 proposed the use of cationic stabilizers for graphite fluoride be used in electroplating with specific attention focused upon surfactants having a C—F bond in their structure.

Brown et al in U.S. Pat. No. 3,677,907, demonstrated the utilization of surfactants also having a C—F bond in their skeleton used in combination with PTFE electrolytic codeposition.

Henry et al in U.S. Pat. No. 4,830,889, demonstrated the utilization of a cationic fluorocarbon surfactant along with a non-ionic fluorocarbon surfactant for the codeposition of graphite fluoride in electroless plating baths.

Feldstein et al in U.S. application Ser. No. 08/077,665 also demonstrated the use of "frozen states" to overcome the limited shelf-life associated with certain dispersions before their use in plating applications.

The above patents reflect the state of the art and they are included herein by reference.

The following patents are provided for their schematic drawings for the machinery parts of interest in this invention.

Schmid in U.S. Pat. No. 5,164,236 describes the coating of open-end rollers with a metal-carbide coating with a nickel overlay thereof. The metal-carbide is deposited by a plasma coating approach.

Herbert et al in U.S. Pat. No. 4,193,253 describes the coating of OE rotors with a silicon carbide composite coating.

The coating of textile machinery parts has been a commercially accepted practice, especially when applied to open-end (OE) spinning operations. For example, combing rolls (beater rolls) and rotors have been coated with composite bearing wear resistance particles such as diamond and silicon carbide. Similarly, rotor shafts used for open-end spinning have been coated primarily with a composite bearing silicon carbide. While it is well documented that the use of composite bearing wear resistance particles extends the lifetime of the machinery part, their use creates certain potential problems as to the degradation of the physical properties of the yarn when contacted with the wear resistant coated machinery part. Accordingly, it is objective of the present invention to substitute the use of composites bearing lubricating particles. This criticality is becoming more pronounced as the speed for such parts is increased from generation to generation. The use of such particulate matter will provide a coated machinery part more friendly towards the yarn and the finish upon such yarns. While commercially the use of composites bearing PTFE particulate matter has been commercially accepted, unfortunately such coatings are not particularly useful in direct loads, nor can they be maximized with respect to the hardness of the coating due to the temperature limitation of PTFE at increased temperatures. In the case of composite with PTFE, the coatings cannot be hardened via heat-treatment above 290° C. Accordingly, to overcome certain of the disadvantages of the prior art, the present invention contemplates the use of a composite bearing lubricating particulate matter such as hexagonal boron nitride, which however, has high temperature capabilities and thereby permits the necessary heat-treatment which generally improves the wear-life and hardness of the coating.

SUMMARY OF THE INVENTION

It is an object of the present invention to improve significantly the performance of open-end spinning textile machinery parts and spinning rings and to eliminate many of the disadvantages associated with prior art coatings.

It is another object of the present invention to use a composite electroless coating bearing finely divided particulate matter having lubricating properties and high temperature capabilities of at least 300° C.

These and other objects of the present invention together with the advantages over the existing prior art and method will become apparent from the following specification and the method described herein.

DESCRIPTION OF THE PREFERRED EMBODIMENTS

According to the concept of the present invention, the formation of a composite electroless coating bearing lubricating particles onto open-end spinning machinery parts (rotors, combing rolls, navals and others), spinning rings and travellers. The use of such coating by contrast to composites bearing hard particles, will result in friendlier contact between the yarn and the coated machinery parts thereby minimizing any damage(s) to the yarns and resulting in improved physical properties for the processed yarn I have also found that the appearance of a composite electroless coating with boron nitride as particulate matter provides with a surface structure similar to a commercial plasma coating used for combing rolls. The use of plasma coating was found in the prior art to be of special benefit in the case of certain fibers, e.g., rayon. However, the plasma coatings are limited in lifetime due to limited wear-life and moreover it is prone to chipping which is typical of vitrious type materials. By contrast, the present composites can provide with metallic matrices having a hardness value of at least 900 Hv.

The following example is an illustration whereby hexagon boron-nitride is codeposited in a hard metallic matrix. It should be noted that the present invention is not limited to the type of bath used herein, but in general for electroless deposits of the various metals and alloys. Moreover, the invention is not limited to the specific boron-nitride dispersion used. In the current example an electroless nickel plating bath, NiPLATE 300 sold by Surface Technology, Inc., was used to provide a Ni—P type alloy. The bath was operated at a pH of 6.3 and a temperature of 167° F. and a cycle time of 90 minutes. Into a plating tank of 10 liters consisting of the NiPLATE 300, a stock dispersion was added comprising of 20% wt of BN in water and a surfactant with a final volume of 11 liters. The open-end spinning machinery parts after normal cleaning and pickling were plated for 90 minutes under the above conditions. A cross sectional cut revealed a significant quantity (several percent by volume) of codeposited BN with a particle size of about 1.3 microns.

Though the present invention primarily focuses upon hexagon boron-nitride as the particulate matter to be used in the composite coatings for the specific textile machinery parts, other particles fall within the spirit of this invention. Specifically, the use of graphite, graphite fluoride, silicon nitride, and molydisulfate fall within the spirit of this invention.

As mentioned previously, it was surprisingly found that composite with hexagon boron-nitride provides a surface topography closely resembling plasma coating useful for these machinery parts, despite the fact that the coating techniques are so diverse.

What I claim is:

1. A textile spinning machinery part having a metallic substrate and a coating formed thereon, said coating consisting essentially of finely divided lubricating particulate matter dispersed within a metal matrix, said particulate matter capable of withstanding heat treatment temperatures of at least 300° C. without degradation thereof.

2. The machinery part according to claim 1, wherein said particulate matter is hexagonal boron-nitride.

3. The machinery part according to claim 1, wherein said machinery part is useful in open-end spinning processing.

4. The machinery part according to claim 1, wherein said machinery part is useful in ring spinning operations.

5. The machinery part according to claim 1, wherein said metal matrix is a nickel alloy.

6. The machinery part according to claim 1, wherein said coating has been subjected to heat-treatment at a temperature of at least 300° C.

7. The machinery part according to claim 1, wherein said metal matrix has a hardness value of at least 900 Hv.

8. The machinery part according to claim 1, wherein said lubricating particulate matter is selected from the group consisting of graphite, graphite fluoride, silicon nitride and mixtures thereof.

9. The machinery part according to claim 1, wherein said metal matrix is a nickel-phosphorous alloy.

10. The machinery part according to claim 9, wherein said nickel-phosphorous alloy is deposited by an electroless method of deposition.

11. The machinery part according to claim 1, wherein said coating has a portion thereof for contacting a textile yarn during use of said textile machinery part.

12. A textile spinning machinery part for contacting yarn during processing thereof, said machinery part having a metallic substrate and a coating formed thereon, said coating consisting essentially of finely divided lubricating particulate matter dispersed within a metal matrix, said particulate matter capable of withstanding heat treatment temperatures of at least 300° C. without degradation thereof.

13. The machinery part according to claim 12, wherein said particulate matter is hexagonal boron-nitride.

14. The machinery part according to claim 13, wherein said nickel-phosphorous alloy is deposited by an electroless method of deposition.

15. The machinery part according to claim 12, wherein said lubricating particulate matter is selected from the group consisting of graphite, graphite fluoride, silicon nitride and mixtures thereof.

16. The machinery part according to claim 12, wherein said metal matrix is a nickel-phosphorous alloy.

17. The machinery part according to claim 12, wherein said coating has a portion thereof for contacting a textile yarn during use of said textile machinery part.

18. The machinery part according to claim 12, wherein said coating has been subjected to heat treatment at a temperature of at least 300° C.

19. A textile spinning machinery part having a metallic substrate and a coating formed thereon, said coating comprising a metallic matrix with finely divided particulate matter dispersed therein, wherein the improvement comprises said finely divided particulate matter consisting essentially of particulate matter having lubricating properties and capable of withstanding heat treatment temperature of at least 300° C. without degradation thereof.

20. The machinery part according to claim 19, wherein said lubricating particulate matter is selected from the group consisting of graphite, graphite fluoride, silicon nitride and mixtures thereof.

21. The machinery part according to claim 19, wherein said metal matrix is a nickel-phosphorous alloy.

22. The machinery part according to claim 21, wherein said nickel-phosphorous alloy is deposited by an electroless method of deposition.

23. The machinery part according to claim 19, wherein said coating has a portion thereof for contacting a textile yarn during use of said textile machinery part.

24. The machinery part according to claim 19, wherein said coating has been subjected to heat treatment at a temperature of at least 300° C.

* * * * *